US005361691A

United States Patent [19]

Hartmann

[11] Patent Number: 5,361,691

[45] Date of Patent: Nov. 8, 1994

[54] DRAINING ELEMENT FOR PRESSES

[75] Inventor: Eduard Hartmann, Schneisingen, Switzerland

[73] Assignee: Bucher-Guyer AG, Maschinenfabrik, Niederweningen, Switzerland

[21] Appl. No.: 66,066

[22] PCT Filed: Aug. 26, 1992

[86] PCT No.: PCT/CH92/00170

§ 371 Date: May 28, 1993

§ 102(e) Date: May 28, 1993

[87] PCT Pub. No.: WO93/06988

PCT Pub. Date: Apr. 15, 1993

[30] Foreign Application Priority Data

Oct. 2, 1991 [CH] Switzerland ..... 2905/91

[51] Int. Cl.[5] ..... B30B 9/02

[52] U.S. Cl. ..... 100/107; 100/125

[58] Field of Search ..... 100/107–109, 100/116, 125

[56] References Cited

U.S. PATENT DOCUMENTS 1,145,372 7/1915 Krause ..... 100/107 X
3,103,164 9/1963 Willmes ..... 100/107
3,207,064 9/1965 Hauser-Bucher ..... 100/107
3,951,058 4/1976 Hauser ..... 100/107
4,475,451 10/1984 Hartmann ..... 100/107
5,130,022 7/1992 Chara ..... 100/125 X

FOREIGN PATENT DOCUMENTS 413599 12/1966 Switzerland ..... 100/107

*Primary Examiner*—Stephen F. Gerrity
*Attorney, Agent, or Firm*—Edmund M. Jaskiewicz

[57] ABSTRACT

The rod-shaped flexible core (6) of a drainage element (2) mounted in a pressing space (1) of a fruit press has several longitudinal grooves (8, 13) on its periphery, through which the extracted juice is conveyed to juice collecting spaces (5). The free ends of each drainage element (2) are detachably fastened by drainage locks (3) to juice collecting plates (4) bordering the pressing space (1). In the area of rigid drainage lock (3), through which the juice is guided, the longitudinal grooves (8) are widened, so that in this area, in which the flexibility of core (6) to assist the flow process is absent, the risk of clogging by solid sediment particles in the juice is prevented.

7 Claims, 3 Drawing Sheets

DRAINING ELEMENT FOR PRESSES

FIELD OF THE INVENTION

The present invention relates to a draining element for presses for extracting liquids from solid substances, especially for fruit presses, more particularly, to a rod-shaped, flexible core with flow channels to discharge the extracted liquid from the pressing space and a liquid-permeable filter cover enclosing the core, and at least one end of the drainage element being fastened by a drainage lock to a juice collecting plate or to the pressing sheath.

DESCRIPTION OF THE PRIOR ART

A substantial number of such draining elements is placed, for example, in the pressing space of a fruit press between the movable and the stationary pressure plates. During the pressing process or during the closing of the movable pressure plate, the flexible draining elements are deformed. In this case, the extracted juice penetrates the filter cover of the draining element and is brought out along the flow channels of the rod-shaped core from the pressing space and conveyed to a juice collecting space. For this purpose, both ends or, in the case of one-sided fastening, only one end of the draining element is detachably fastened to the pressure or juice collecting plates, which, on the one hand, border the pressing space and, on the other hand, the juice collecting space. The flow channels for the juice are formed by longitudinal grooves on the outside periphery of the core and terminate in the juice collecting space just before the drainage lock.

Depending on the particular materials being pressed, a large quantity of fine solid and sediment parts are entrained in the extracted juices. During the flow of the extracted juices, small lumps of sediment and solids may be formed in the longitudinal grooves of the drainage element. These lumps are urged in their flow through the grooves by the bending movements of the flexible drainage cores. But along the length of the rigid drainage locks, this flexing movement is lacking, and partially solid sediment plugs which have been formed tend to clog the longitudinal grooves of the drainage core. The juice discharge is then greatly obstructed which results in increased losses of yield and output. The removal of the clogging lumps is often very difficult and time-consuming, since the drainage elements must be removed and the operating sequence of the press is interrupted. Moreover, a chemical cleaning is generally necessary.

SUMMARY OF THE INVENTION

The object of the invention is to avoid said drawbacks and to prevent clogging of the grooves in the area of the drainage locks so as to improve the function and the output of the press.

This object is achieved according to the invention by enlarging the flow channels of the drainage element in the area of the drainage lock.

Advantageously, the flow channels of the drainage element are formed by longitudinal grooves, located on the outside periphery of the core, and the grooves are enlarged in the area of the drainage lock.

An especially simple embodiment which is also usable in existing juice presses, for enlarging the longitudinal grooves is achieved by removing every second ridge of the drainage core formed between the longitudinal grooves in the area of the drainage lock.

In another modification of the invention, the longitudinal grooves are conically widened in the area of the drainage lock.

Another modification to enlarge the flow channels consists of increasing the depth of the longitudinal grooves in the area of the drainage lock along the length of the drainage lock.

A particular advantage of the present invention is that because of the widening of the flow channels in the area of the rigid drainage lock, the sediment parts are no longer inhibited in their flowing movement and are immediately flushed outward into the juice collecting space. The retention time of the extracted juices in the widened flow channels is too short for a quick accumulation of the sediment particles. Any clogging of the flow channels is thus successfully prevented and the output of the press is increased. The interval between the periodic cleaning processes of the press can thus also be increased.

BRIEF DESCRIPTION OF THE DRAWING

The invention is explained in more detail in the following description and the drawings which are exemplary wherein.

DESCRIPTION OF THE PREFERRED EMBODIMENTS

Figure 1:
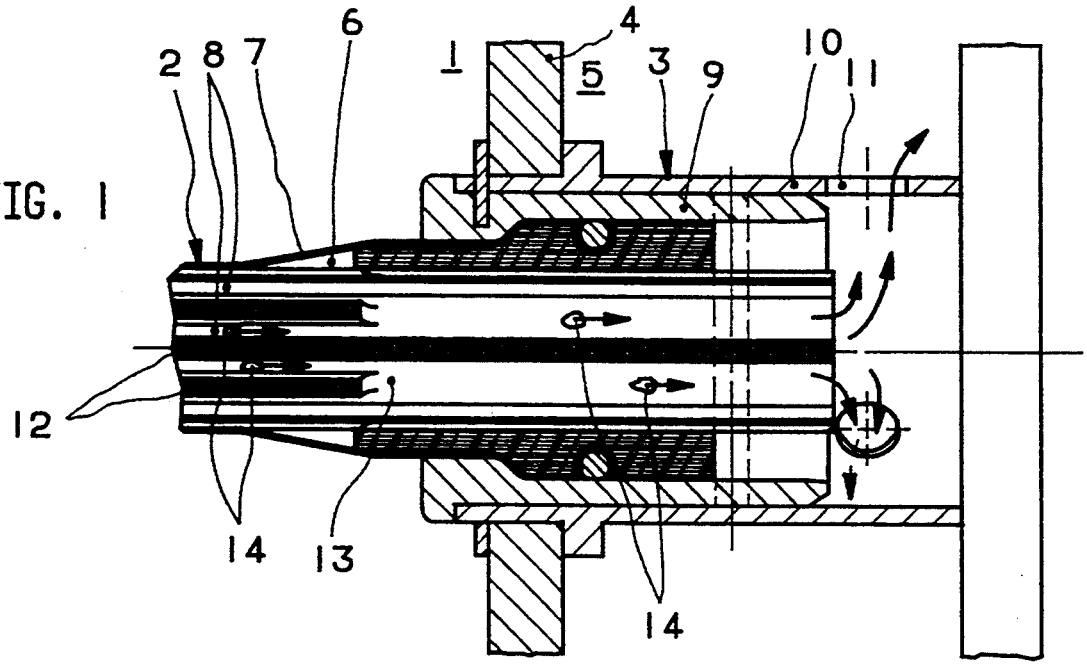
FIG. 1 is a longitudinal section through the fastening of the drainage element.
Figure 2:
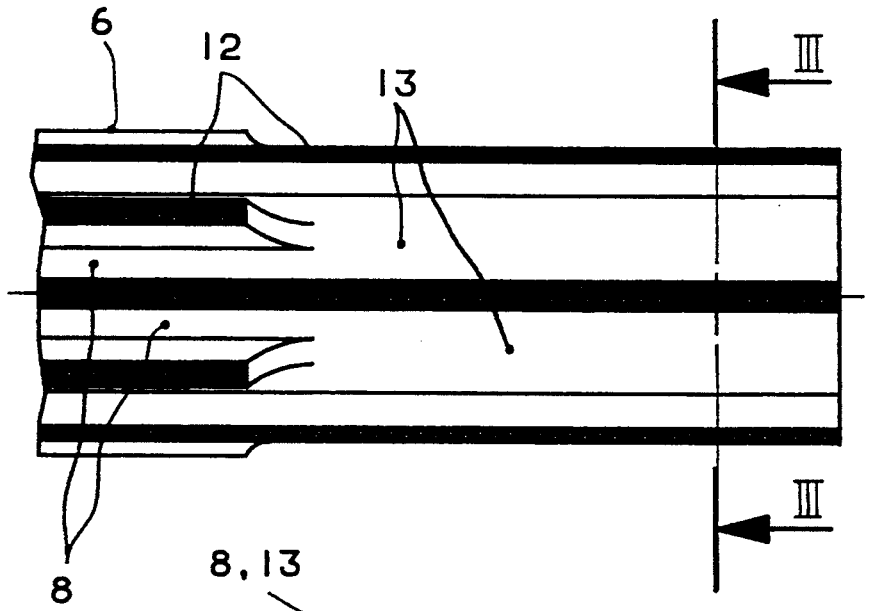
FIG. 2 is an enlarged view of one end of the drainage element.
Figure 3:
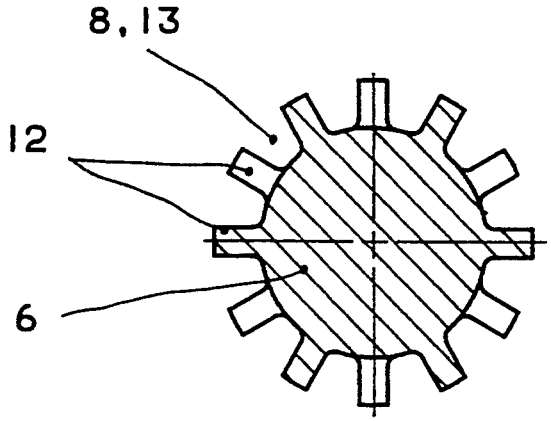
FIG. 3 is a section through the drainage element along line III—III in FIG. 2.

Several drainage elements 2 are assembled in a pressing space 1 of a fruit press, not represented in more detail. The free ends of each drainage element 2 are detachably fastened by a drainage lock 3 to juice collecting plates 4, which, on the one hand, border the pressing space 1 and, on the other hand, juice collecting spaces 5. For the sake of simplicity, only one of two juice collecting plates 4 is represented, the other being constructed as a movable pressure plate. Each drainage element 2 has a rod-shaped, flexible core 6, which is enclosed by a stockinglike filter cover 7. Core 6 has several longitudinal grooves 8 distributed on the periphery thereof, which function as flow channels for the extracted juice. The fastening of filter cover 7 to core 6 is achieved by a plug part 9, which penetrates juice collecting plate 4 with a sleeve 10. Plug part 9, sleeve 10 and juice collecting plate together form tube drainage lock 3, which permits a detachable fastening of drainage element 2 to juice collecting plate 4. Sleeve 10, which projects into juice collecting space 5, has boreholes 11 therein for the output of the juice, which has been guided by the longitudinal grooves 8 on drainage element 2 through drainage lock 3.

Ridges 12, by which longitudinal grooves 8 are separated from one another, are formed between longitudinal grooves 8 of core 6. On the ends of core 6, respectively every second ridge 12 is removed. As a result, new longitudinal grooves 13 are formed which have widths about two to three times greater than the longitudinal grooves 8. The length of longitudinal grooves 13 corresponds to approximately the length of the area in which drainage element 2 is immovable because of its being mounted in the rigid drainage lock 3.

The functioning of the invention is as follows: During the pressing process, the juice collecting plate which is the movable pressure plate is closed in an axial direction against stationary juice collecting plate 4, and flexible drainage elements 2 perform bending movements and buckle laterally. As a result, the extracted juice passes through liquid permeable filter cover 7 to core 6 and is conveyed by longitudinal grooves 8 and 13 to juice collecting space 5.

Solid sediment parts 14 formed during the flowing process are removed along longitudinal grooves 8, under the action of the bending movements of drainage element 2 and reach the area of rigid drainage lock 3, where the urging movement by the flexibility of drainage element 2 is absent, into widened longitudinal grooves 13. Because of the enlarged flow cross sectional areas of longitudinal grooves 13, solid sediment parts 14 are guided, without clogging, together with the juice into juice collecting space 5.

Figure 4:
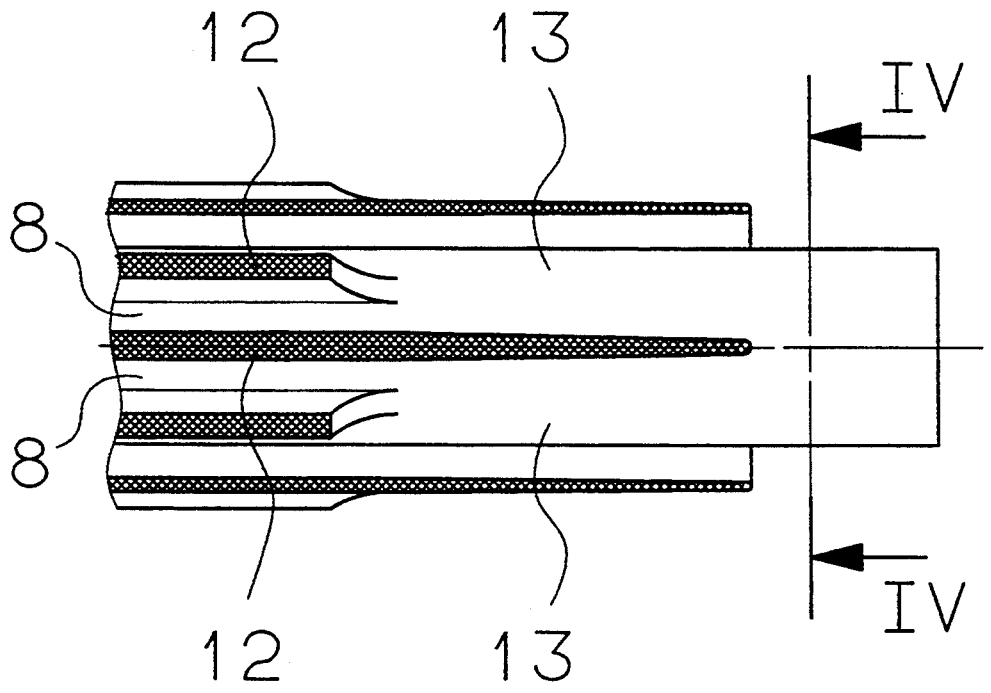
FIG. 4 is an enlarged view of one end of the drainage element similar to the view of FIG. 2 but showing the ridges being tapered to form conical grooves.
Figure 5:
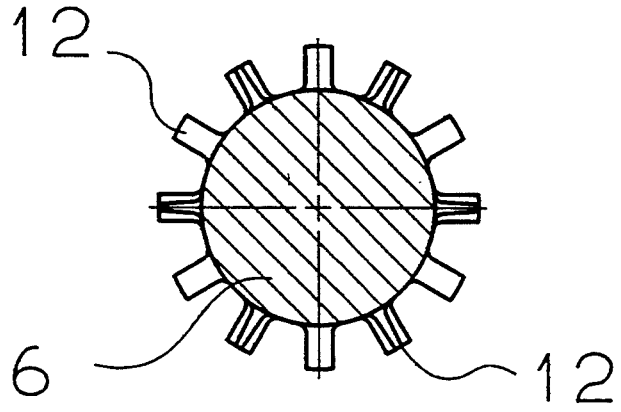
FIG. 5 is a section taken along the line IV—IV of FIG. 4.
Figure 6:
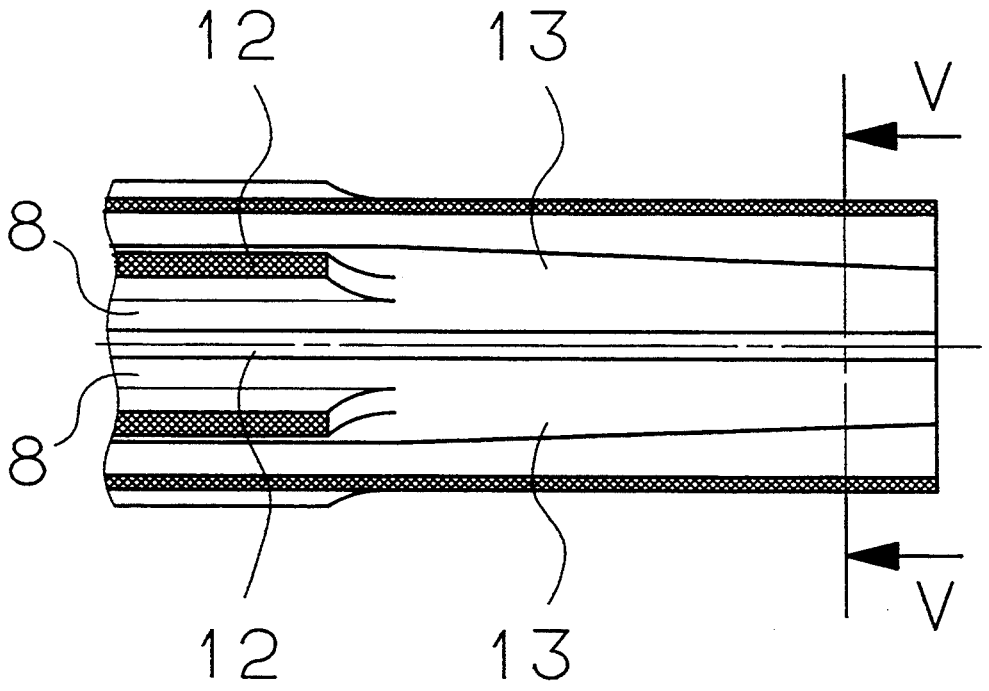
FIG. 6 is an enlarged view of one end of the drainage element similar to the view of FIG. 2 but showing the increasing depth of the grooves.
Figure 7:
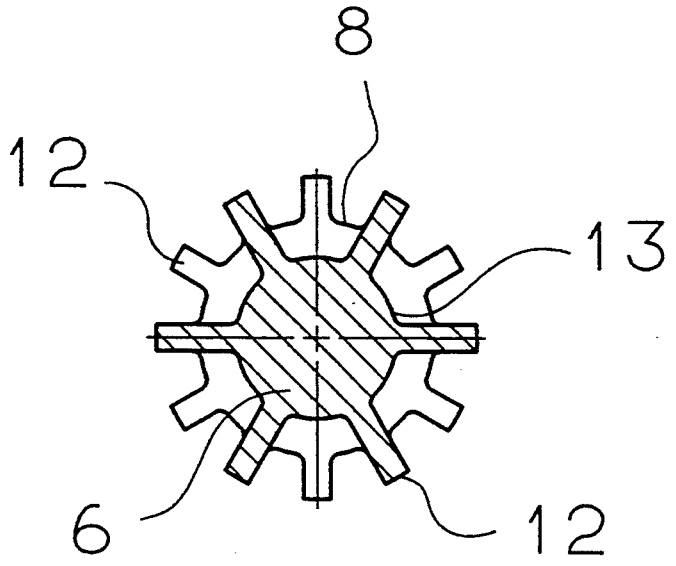
FIG. 7 is a section taken along the line V—V of FIG. 6.

Instead of the removal of ridges 12, longitudinal grooves 10 can be conically widened in the area of the drainage lock as seen in FIGS. 4 and 5 to enlarge the flow channels. Also, the depth of the grooves can be increased as shown in FIGS. 6 and 7.

We claim:

1. Draining element for presses to extract liquids from solid substances comprising a rod-shaped, flexible core with flow channels thereon to discharge extracted liquid from a pressing space of a press and a liquid-permeable filter cover enclosing the core, said flow channels each having first widths thereof, at least one end of the drainage element being fastened by a drainage lock to one of a juice collecting plate and on a pressing sheath of a press, the flow channels of the draining element (2) being enlarged in the area of drainage lock (3) such that the enlarged flow channels have second widths which are greater than said first widths and the lengths of said enlarged flow channels correspond substantially to the length of said drainage lock.

2. Draining element according to claim 1 wherein the flow channels of the drainage element (2) are defined by longitudinal grooves (8, 13), disposed on the outside periphery of the core (6), which are enlarged in the area of the drainage lock (3).

3. Drainage element according to claim 2 wherein the depth of the longitudinal grooves (8, 13) is increased substantially throughout the length of the drainage lock (3).

4. Draining element according to claim 2, wherein the longitudinal grooves (13) define ridges therebetween and alternate ones of said ridges terminate at said drainage lock (3).

5. Draining element according to claim 4 wherein the depth of longitudinal grooves (8, 13) is increased substantially throughout the length of the drainage lock (3).

6. Draining element according to claim 1 wherein the flow channels (8) are conically widened substantially throughout the length of the drainage lock (3).

7. Draining element according to claim 6, wherein the depth of longitudinal grooves (8, 13) is increased substantially throughout the length of the drainage lock (3).

* * * * *